US006494813B2

(12) United States Patent
Chen

(10) Patent No.: US 6,494,813 B2
(45) Date of Patent: Dec. 17, 2002

(54) STEPPER WITH ADDITIONAL FUNCTIONS TO STRENGTHEN THE ARMS AND THE BREAST

(76) Inventor: Gordon Chen, No. 123, Chung Kang Street, Taichung City (TW)

( * ) Notice: Subject to any disclaimer, the term of this patent is extended or adjusted under 35 U.S.C. 154(b) by 0 days.

(21) Appl. No.: 09/853,578

(22) Filed: May 14, 2001

(65) Prior Publication Data

US 2002/0169053 A1 Nov. 14, 2002

(51) Int. Cl.[7] ..... A63B 22/14; A63B 22/04
(52) U.S. Cl. ..... 482/53; 482/146
(58) Field of Search ..... 482/51, 52, 53, 482/72, 73, 146–147; 601/35

(56) References Cited

U.S. PATENT DOCUMENTS 5,478,298 A * 12/1995 Chen ..... 482/95
5,545,111 A * 8/1996 Wang et al. ..... 482/53
5,628,709 A * 5/1997 Chen ..... 482/53
5,672,142 A * 9/1997 Wu ..... 482/96

* cited by examiner

*Primary Examiner*—Stephen R. Crow
(74) *Attorney, Agent, or Firm*—Rosenberg, Klein & Lee

(57) ABSTRACT

The present invention relates to a stepper with additional functions to strengthen the arms and the breast which includes a stepper and a pull rod both of which are fitted to a base. The stepper has two treads each of which has a front assembly pivotably connected to the base. The pull rod is pivotably connected to upright rods at front end of the base. Moreover, it is coupled with a movable handle at top thereof and a connecting rod at bottom thereof. The other end of the connecting rod is pivotably connected to the front assembly of the stepper. Accordingly, the pull rod, the connecting rod and the front assembly are coupled with one another. A position-limiting bar is inserted through the front end extending from the outer side of the upright rods.

2 Claims, 9 Drawing Sheets

STEPPER WITH ADDITIONAL FUNCTIONS TO STRENGTHEN THE ARMS AND THE BREAST

BACKGROUND OF THE INVENTION

1. Field of the Invention

The present invention relates to a stepper with additional functions to strengthen the arms and the chest, and more particularly, to a device to combine the stepping device with the arm and chest strengthening trainer.

2. Description of the Prior Art

As illustrated in FIG. 1, the earlier conventional mini stepper 1 has no components for the operator to hold on so that it's unsafe in using. Thereafter, an improved stepper 2, as shown in FIG. 2, is fitted with a handle 21 for the operator to hold on to keep body balance. However, the monotone stepping action can't reach the whole body exercise. Moreover, it tends to become boring for the operator. Thus, the persistence to use the exerciser will gradually disappear.

SUMMARY OF THE INVENTION

It is a primary object of the present invention to provide a stepper with additional functions to strengthen the arms and the chest in which the stepper and the arm and chest strengthening components can be dependently or independently operated. Therefore, the effect to combine the stepping exercise with the arm and the chest strengthening training is achieved.

It is another object of the present invention to provide a stepper with additional functions to strengthen the arms and the chest through which a variety of exercises can be done so that a multifunctional device is attainable.

It is a further object of the present invention to provide a stepper with additional functions to strengthen the arms and the chest through which the body weight of the user serves as load when the operator takes the arm and chest strengthening training. Moreover, the whole design has the advantages of not occupying space and of being easy to operate.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
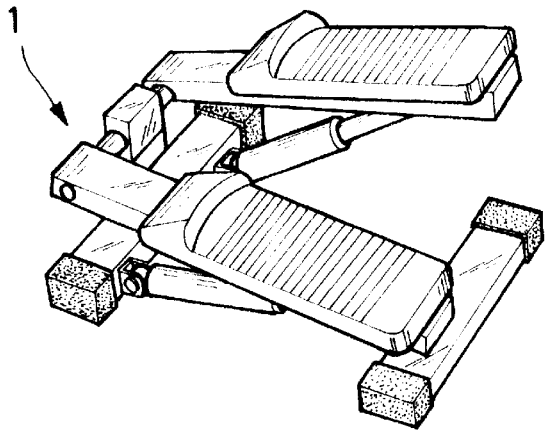
FIG.1 PRIOR ART
FIG. 1 is a perspective view of an earlier conventional mini stepper.
Figure 2:
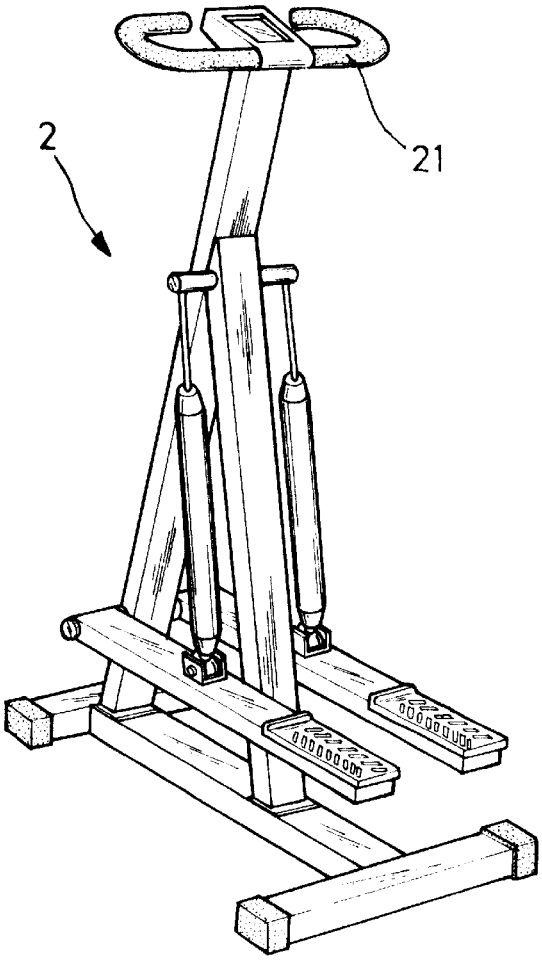
FIG.2 PRIOR ART
FIG. 2 is a perspective view of an improved conventional stepper.
Figure 3:
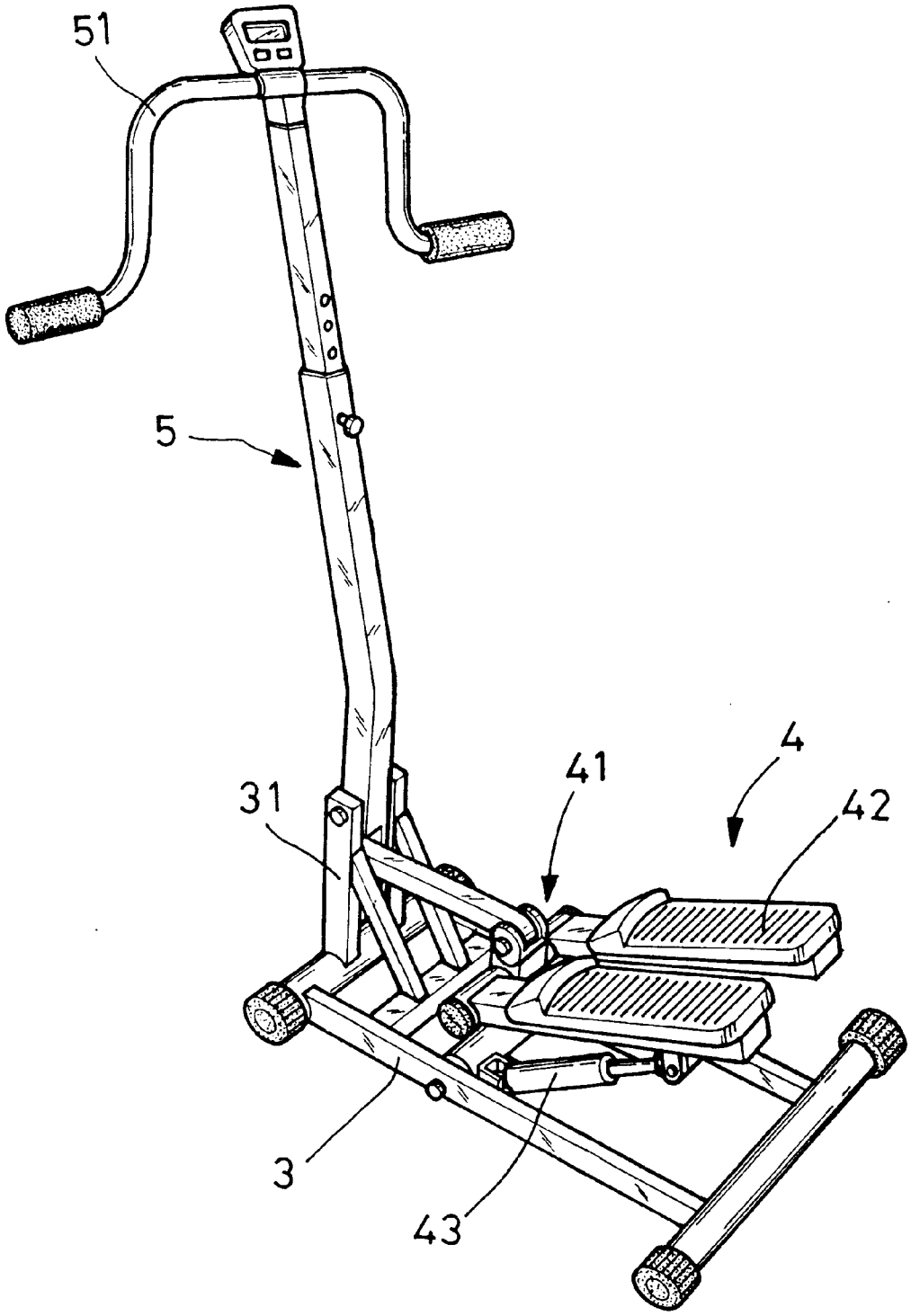
FIG. 3 is a perspective view of the present invention.
Figure 4:
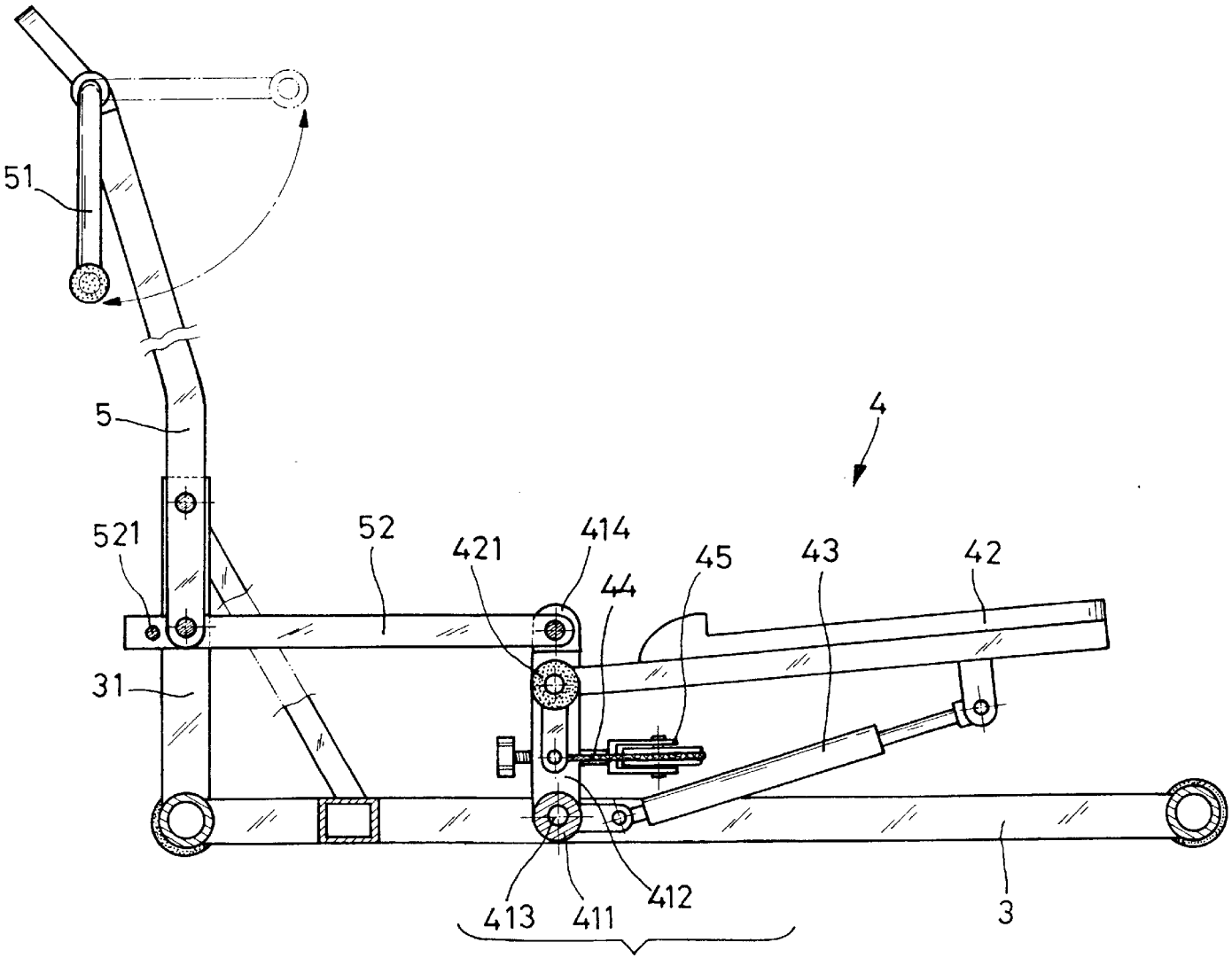
FIG. 4 is a side view of the present invention whose treads is in a substantially horizontal position.
Figure 5:
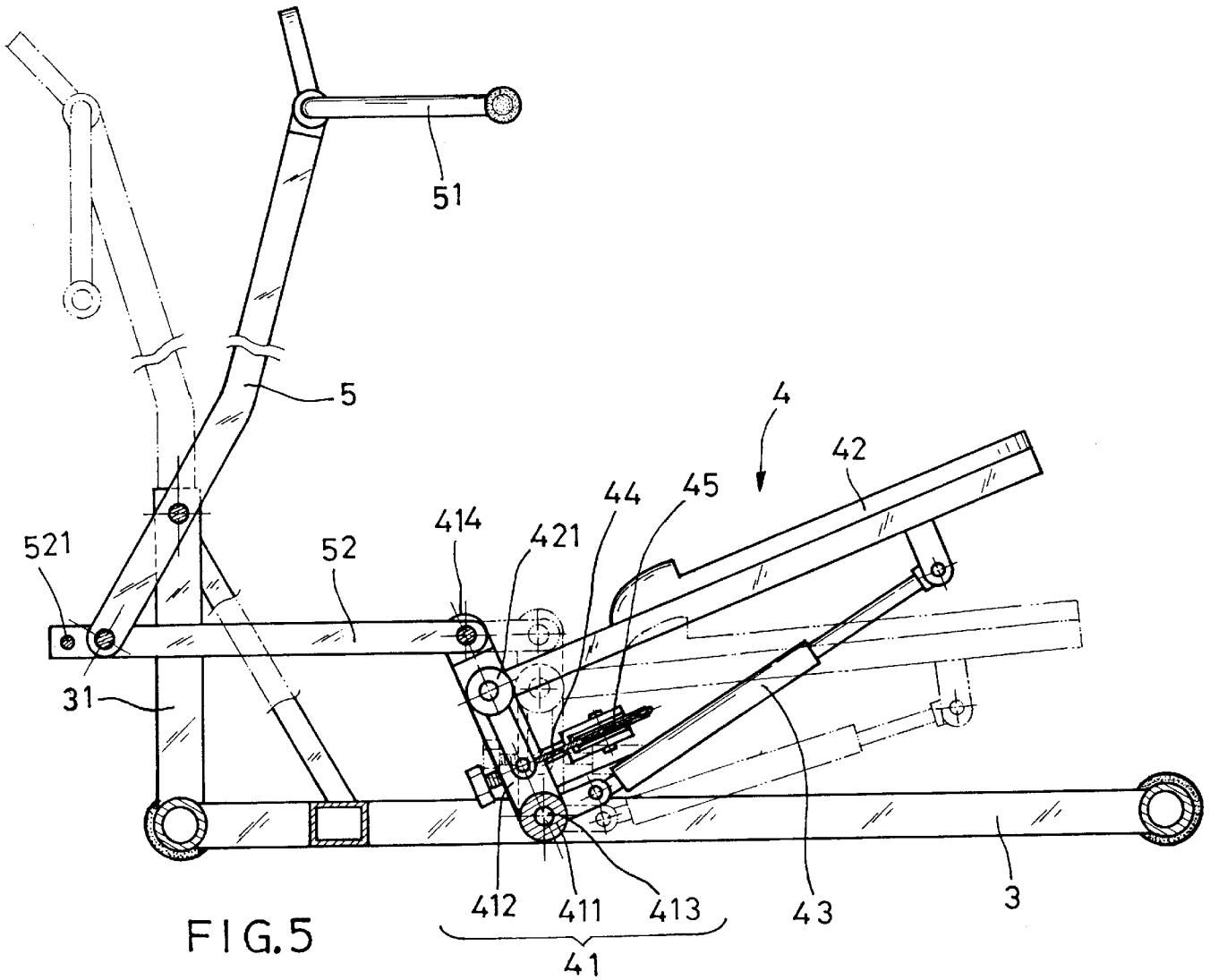
FIG. 5 is a side view of the present invention whose tread is raised.
Figure 6:
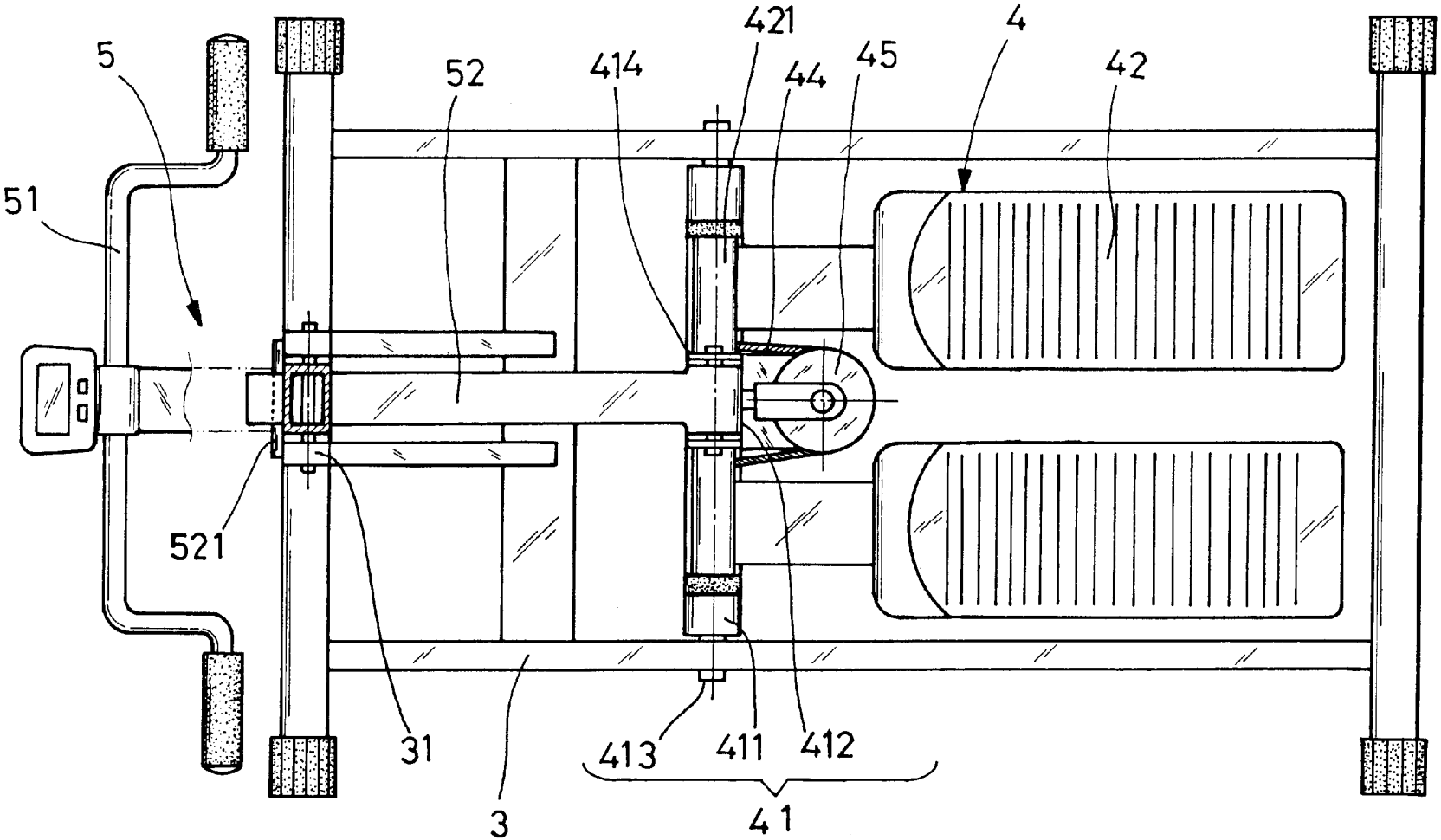
FIG. 6 is a top view of the present invention.

First of all, referring to FIGS. 3 through 7, the present invention includes a stepper 4 and a pull rod 5 both of which are fitted to a base 3.

The stepper 4 has two treads 42 each of which has a front assembly 41 pivotably connected to the base 3.

The pull rod 5 is pivotably connected to upright rods 31 at front end of the base 3. Moreover, it is coupled with a movable handle 51 at top thereof and a connecting rod 52 at bottom thereof The other end of the connecting rod 52 is pivotably connected to the front assembly 41 of the stepper 4. Accordingly, the pull rod 5, the connecting rod 52 and the front assembly 41 are coupled with one another. A position-limiting bar 521 is inserted through the front end extending from the outer side of the upright rods 31.

Moreover, the front assembly 41 of the stepper 4 comprises a transverse rod 411 and a mounting body 412. The transverse rod 411 of the stepper 4 is swiveled on a pivot 413 while the mounting body 412 thereof includes a top part 414 in pivotal connection with the connecting rod 52.

A turn shaft 421 of two treads 42 of the stepper 4 is fitted to two mounting bodies 412. Each of the treads 42 hat underneath an oil pressurized cylinder 43 the other end of which is fitted to the transverse rod 411 of the front assembly 41. A guide wheel 45 disposed between two treads 42 has a guide rope 44 extending around it and moving the treads 42 one after another.

Figure 7:
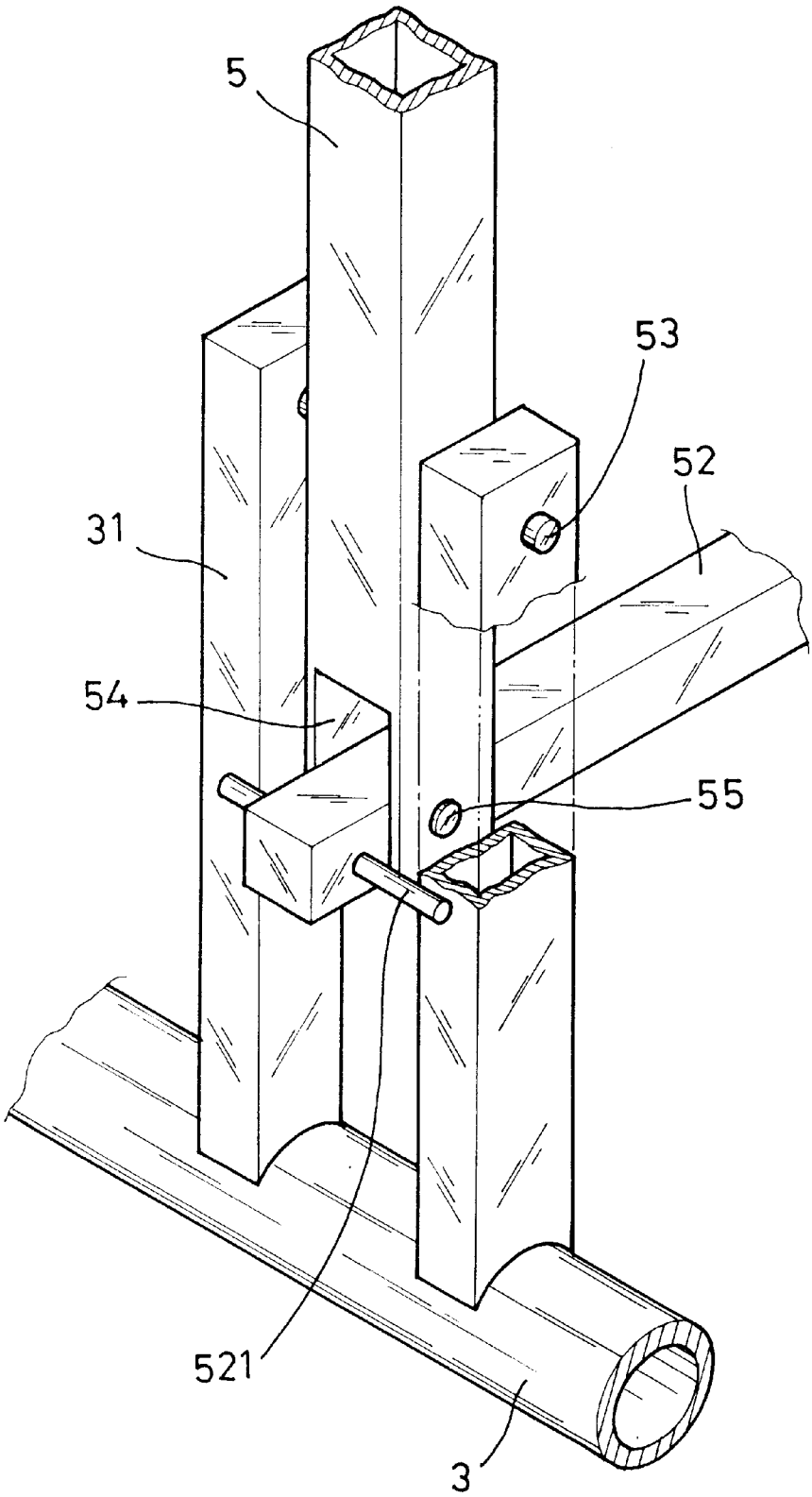
FIG. 7 is a perspective view of the pull rod in combination with the upright rods.

Furthermore, as illustrated in FIG. 7, the pull rod 5 swivels on a turn pin 53 extending between two upright rods 31. The bottom end thereof is constructed as upside down U-form 54 so that the pull rod 5 and the connecting rod 52 are pivoted together by a pin 55.

Figure 8:
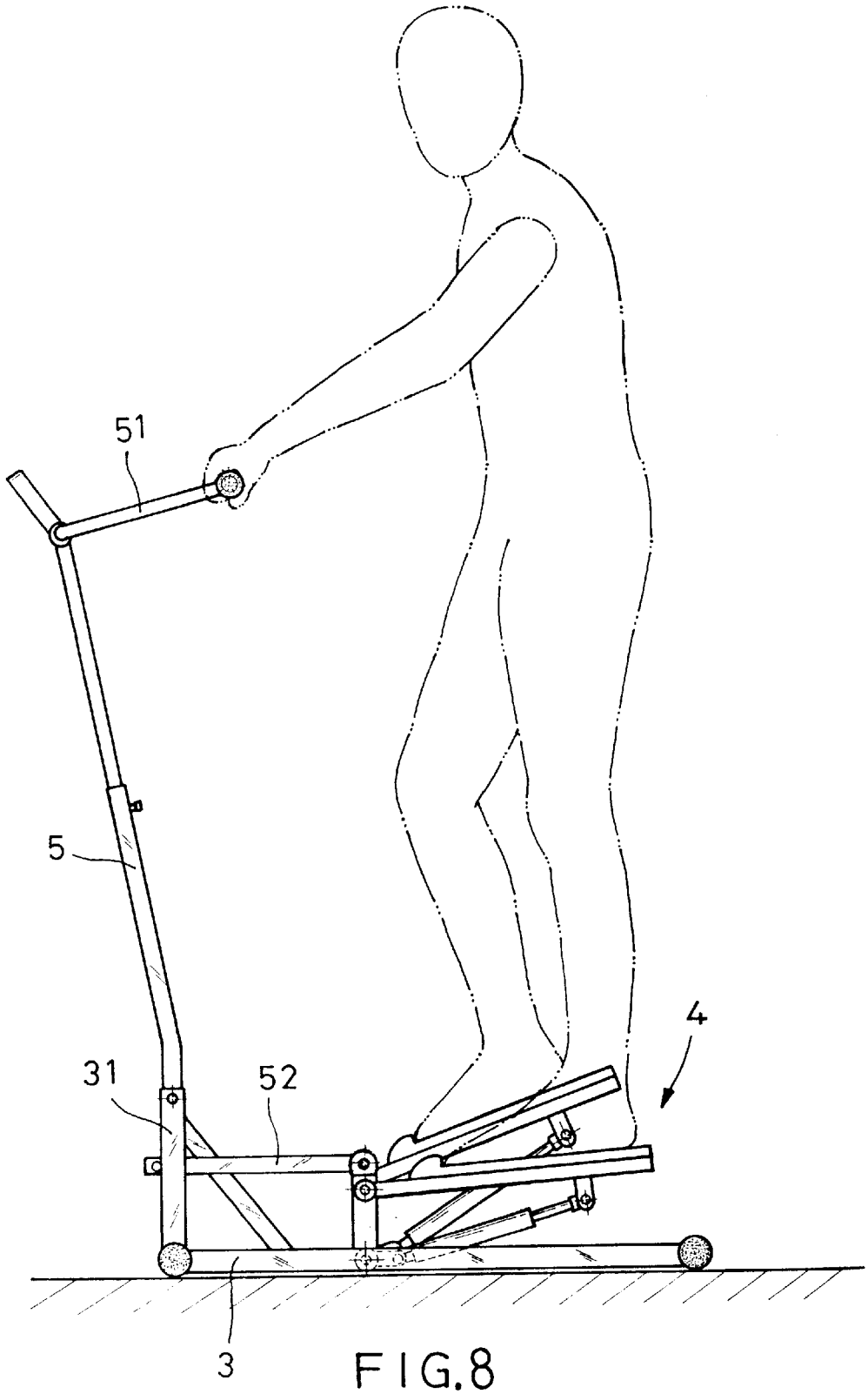
FIG. 8 is a first application view of the present invention.
Figure 9:
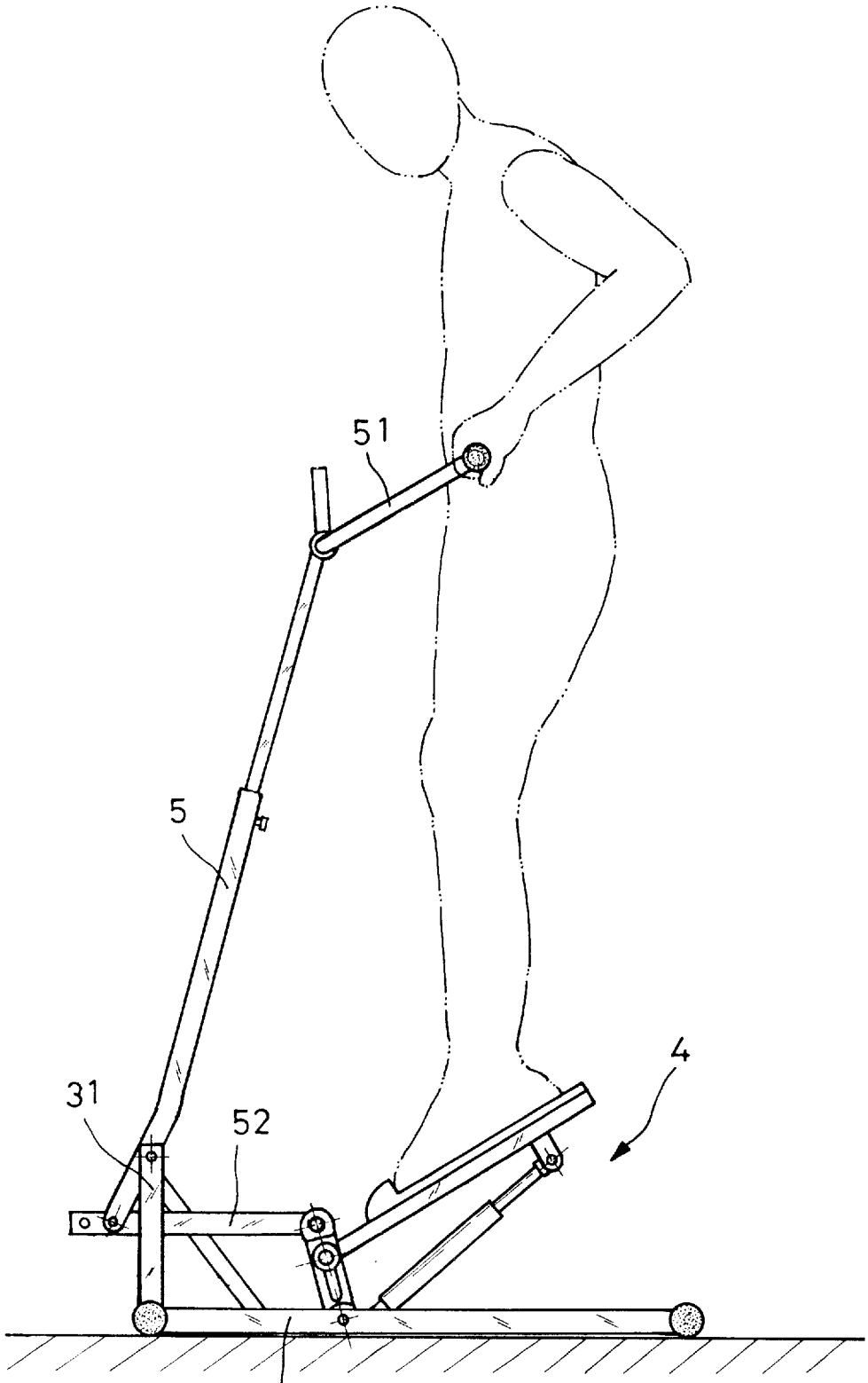
FIG. 9 is a second application view of the present invention.
Figure 10:
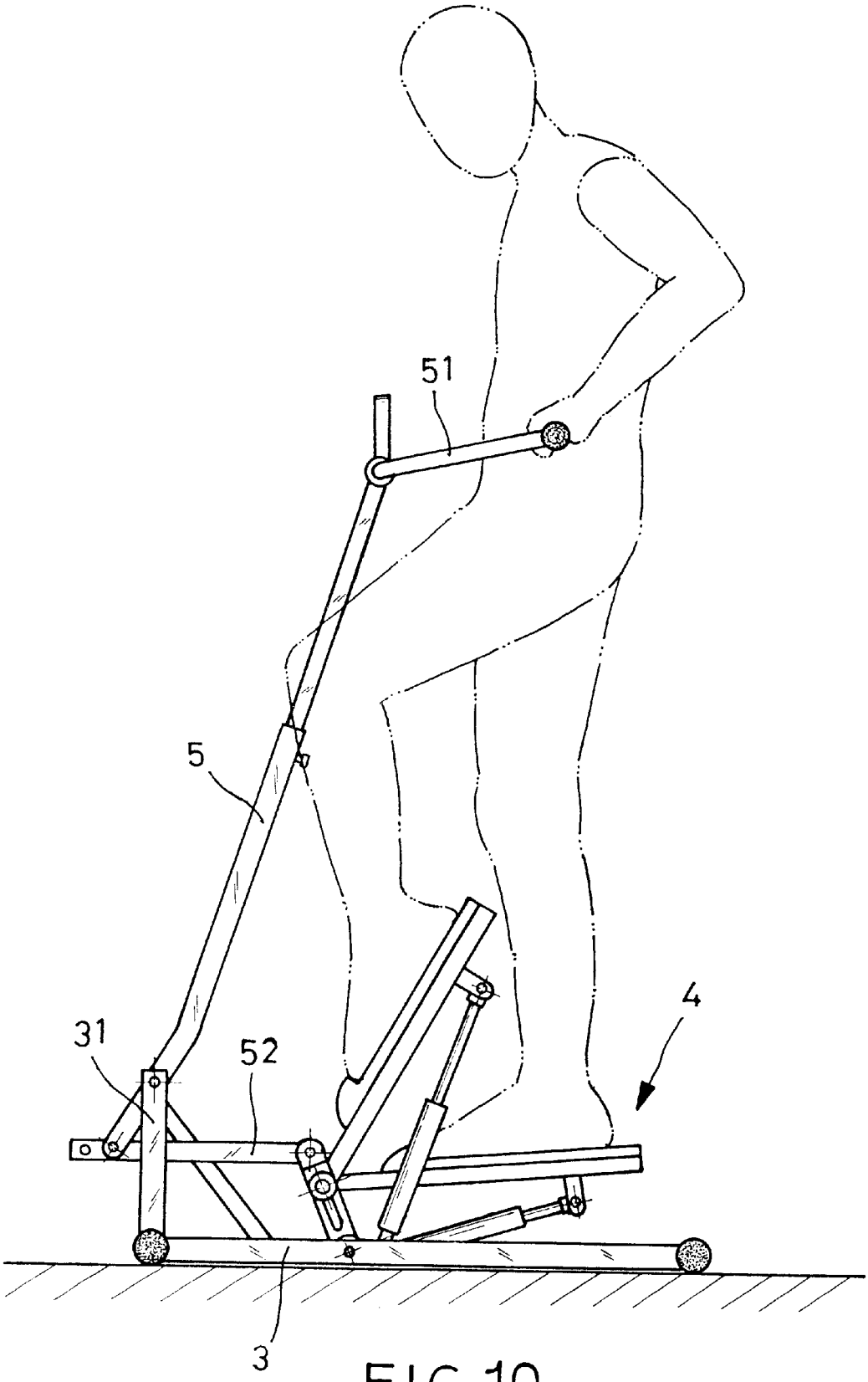
FIG. 10 is a third application view of the present invention.

Based on the above-mentioned components, the present invention has a few different applications. As shown in FIG. 8, both hands hold the movable handle 51 while both feet stand on the treads 42 for an exercise session. This provides only the stepping function. As shown in FIG. 9, both feet stand on the stepper 4 and remain unmoved while both hands pull the movable handle 51 backwards. This pull force will bring the connecting rod 52 forward to raise the stepper 4. Meanwhile, the body weight of the operator creates a load which must be overcome by both hands so that the effect to strengthen the arms and the chest is attainable. In addition, the stepping exercise and the exercise to strengthen the arms and the chest can be combined, as shown in FIG. 10. Accordingly, the coordination training of the body actions can also be achieved.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. An exercise device with additional functions to strengthen the arms and the chest comprising a stepper and a pull rod, both of which are fitted to a base, wherein the improvement is characterized in:

said stepper having two treads, each of which includes a front assembly pivotally connected to said base, each of said treads being coupled to an oil pressurized cylinder, each said oil pressurized cylinder creating hydraulic resistance to movement; and, said pull rod being pivotally connected to a pair of upright rods at a front end of said base, said pull rod being coupled with a movable handle at a top end thereof and a connecting rod at a bottom end thereof, the other end of said connecting rod being pivotally connected to said front assembly of said stepper so that said pull rod, said connecting rod, and said front assembly are coupled with one another, a position-limiting bar being inserted through said front end of said connecting rod extending from an outer side of said upright rods, said pull rod and said handle having a user-driven forward-backwards movement.

2. The exercise device with additional functions to strengthen the arms and the chest as recited in claim 1, wherein said front assembly of said stepper comprises a transverse rod and a mounting body, and said transverse rod of said stepper is swivelled on a pivot while said mounting body thereof includes a top part in pivotal connection with said connecting rod, and wherein a turn shaft of said treads of said stepper is fitted to two mounting bodies, and each of said treads having one of said oil pressurized cylinders connected underneath, the other end of which is fitted to said transverse rod of said front assembly, and a guide wheel disposed between said two treads has a guide rope extending around a periphery thereof, said guide wheel driving said treads in alternating succession.

* * * * *